US011793335B2

(12) United States Patent
Kunst

(10) Patent No.: US 11,793,335 B2
(45) Date of Patent: Oct. 24, 2023

(54) INTERCONNECTABLE DINNER PLATES WITH INTEGRATED RIM ELEMENT

(71) Applicant: David Immanuël Kunst, Rijssen (NL)

(72) Inventor: David Immanuël Kunst, Rijssen (NL)

( * ) Notice: Subject to any disclaimer, the term of this patent is extended or adjusted under 35 U.S.C. 154(b) by 0 days.

(21) Appl. No.: 17/832,074

(22) Filed: Jun. 3, 2022

(65) Prior Publication Data

US 2023/0010435 A1 Jan. 12, 2023

(30) Foreign Application Priority Data

Jul. 7, 2021 (EP) ..... 21075007

(51) Int. Cl.
*A47G 19/08* (2006.01)

(52) U.S. Cl.
CPC ..... *A47G 19/08* (2013.01)

(58) Field of Classification Search
CPC ..... A21B 3/132; A21B 3/134; A47G 19/02; A47G 19/06; A47G 19/065; A47G 19/08; A47G 19/10; A47G 21/14; A47G 21/145; A47G 23/0225; A47G 23/0633; B65D 21/0206; B65D 21/0208
USPC ..... 211/41.2; 220/23.2, 23.4, 23.6, 23.8, 220/23.83
See application file for complete search history.

(56) References Cited

U.S. PATENT DOCUMENTS 46,692 A * 3/1865 Morse et al. ..... A47G 21/14 248/231.71
556,200 A * 3/1896 McDonald ..... A47G 23/0225 248/500
1,258,792 A * 3/1918 Lorimer ..... A47G 23/0225 248/302
1,440,544 A * 1/1923 Katzinger ..... A21B 3/132 220/23.2
1,583,523 A * 5/1926 Briscoe ..... A21B 3/132 249/52
1,700,200 A * 1/1929 Gymer ..... A47G 21/145 248/37.3
1,800,109 A * 4/1931 Selig ..... A23G 9/227 52/712

(Continued)

FOREIGN PATENT DOCUMENTS

CN 201920318 U 8/2011
CN 201920350 U 8/2011

(Continued)

*Primary Examiner* — Joshua E Rodden

(74) *Attorney, Agent, or Firm* — R. Neil Sudol; Henry D. Coleman

(57) ABSTRACT

Interconnectable table or dinnerware articles each include an integrated rim element for releasably interconnecting the dinnerware. The rim element is a small local extension of a rim and takes the form of a U-shaped grip or slide element with an upper and a lower radial lip length L1, L2 and a thickness T. The upper lip and lower lip form a mouth opening with a width D for sideways sliding over the rim of a central dinner plate, wherein the rim element has a circular width B. On an inner side the rim element of an outer dinnerware item has a concave shape fitting exactly into the convex shape of the rim of the supporting central dinner plate. Both the upper radial lip and the lower radial lip of the rim element have an upstanding curvature that corresponds with the curvature of the rim of the central dinner plate.

12 Claims, 6 Drawing Sheets

(56) References Cited

U.S. PATENT DOCUMENTS 2,058,002 A * 10/1936 Daum ..... F25D 25/027 211/77
2,188,558 A * 1/1940 Smith ..... A21B 3/132 99/DIG. 15
2,563,067 A * 8/1951 Pyle ..... A21B 3/132 220/692
D165,782 S 1/1952 Parker ..... D7/533
2,597,468 A 5/1952 Goldie ..... A47J 47/00 141/363
3,194,426 A 7/1965 Brown, Jr.
3,651,976 A * 3/1972 Chadbourne ..... B65D 21/045 220/23.6
4,220,079 A 9/1980 Sims ..... A47G 19/22 206/0.5
4,286,742 A * 9/1981 Pellegrino ..... B60N 3/102 296/37.9
4,867,330 A * 9/1989 Venne ..... A47G 23/06 206/557
4,961,555 A * 10/1990 Egan, Jr. ..... A47G 23/0225 248/314
5,024,067 A 6/1991 Maier
5,054,636 A * 10/1991 Netzer ..... B65D 67/02 24/456
5,181,297 A * 1/1993 Andrews, Jr. ..... B65D 67/02 24/336
D334,704 S * 4/1993 Andrews, Jr. ..... D34/1
5,222,622 A 6/1993 Laske, Jr.
D350,456 S * 9/1994 Linder ..... D7/620
5,361,932 A * 11/1994 Friedrich ..... A47G 23/0225 206/217
5,446,995 A * 9/1995 Huber ..... A01G 9/027 220/23.4
D720,573 S 1/2015 Pola ..... D7/396.2
9,955,810 B1 * 5/2018 Diederich ..... A47G 23/0225
10,667,635 B1 * 6/2020 Howley ..... A47G 23/0225
11,259,658 B2 * 3/2022 Cherewaty, Jr. ..... A47G 19/30
2015/0001233 A1 * 1/2015 Edwards ..... A47G 23/0225 220/737
2019/0344608 A1 * 11/2019 Baker ..... B44D 3/123

FOREIGN PATENT DOCUMENTS

CN 201958471 9/2011
CN 107550185 A 1/2018
DE 102007053683 A 5/2009
FR 2754519 A1 * 4/1998 ..... B65D 21/0206
GB 2412082 A * 9/2005 ..... A47G 19/08
NL 1027288 C2 4/2006
WO WO2012/045061 A2 4/2012

* cited by examiner

INTERCONNECTABLE DINNER PLATES WITH INTEGRATED RIM ELEMENT

BACKGROUND OF THE INVENTION

The present invention concerns several identical dinner plates of which some (called the outer dinner plates) can be temporarily grouped around and interconnected with one identical dinner plate, that is placed in the middle (called the central dinner plate). By interconnecting these dinner plates, a rigid set of 2 to 10 interconnected dinner plates is formed, that is much more stable to hold and carry than several conventional dinner plates that are not interconnected and therefore loose and wobbly. The set of interconnected dinner plates can be held and carried at the central dinner plate with just one hand. The set of interconnected dinner plates makes it possible for the waiter or waitress to serve more dinner guests simultaneously, saves labour costs, shortens the waiting time for the dinner guests, reduces the cooling down of the food, reduces the number of accidents and reduces the number of logistical errors. Also, the set of dinner plates enables the waiter or waitress to have his or her other hand free for opening doors, switching on the light, serving the dinner plates, etcetera. In this way, the set of interconnected dinner plates makes carrying and serving of several dinner plates much easier, safer and more efficient. The interconnecting of the dinner plates is achieved by providing the dinner plates with a unique and special integrated U-shaped rim element. Except for dinner plates, the principle of this intervention is applicable to saucers, pastry dishes, cups and saucers, serving trays or any other dish-shaped table ware.

The state of the art does not include a very effective way to simultaneously serve several guests at a table with dinner plates containing all kinds of food at the same time. The maximum number of dinner plates that the average waiter or waitress can handle is three. In this case, the waiter or waitress has to use both hands. This can be a disadvantage because of the cooling down of the food and the guests will have to wait until all of them have been served. In practice you can only use a clumsy big tray with just a few dinner plates. So, the problem is not solved. Patent Application EP 19075018, filed Dec. 12, 2019, applicant and inventor David Immanuël KUNST, Rijssen, The Netherlands, describes temporarily mutually connectable cups, mugs or bowls. Said patent application describes an inventive solution for a compact set of cups with a handle to serve a group of people. However, the technical way of interconnecting cups, as described in patent application EP 19075018, is not suitable for interconnecting dinner plates. That is why another technical way has been devised for interconnecting dinner plates, as described in this patent application. The result is the same, linking several identical dinner plates around a centrally placed dinner plate, with the centrally placed dinner plate being held by the waiter or waitress.

OBJECTION OF THE INVENTION

The object of this invention is to make holding, carrying and serving of several dinner plates safer, easier and more efficient. So, one person (possibly the waiter or waitress) can easily and rapidly serve more people (guests) at the same time. The waiter/waitress takes off one dinner plate with his/her free hand, serves said dinner plate and in the meanwhile he/she supports the dinner plate set with his/her other hand, until all the dinner plates are served out. So, the restaurant gets more client satisfaction and lower costs for the restaurant operator/manager.

SUMMARY OF THE INVENTION

Interconnectable dinner plates, saucers, pastry dishes or cups and saucers provided with an integrated rim element to create a set of interconnected dinner plates, saucers, pastry dishes or cups and saucers in order to efficiently serve food or drinks to people (guests), wherein said dinner plates, saucers, pastry dishes or cups and saucers are characterized in that said integrated rim element is executed as a small local extension of the rim of the dinner plate, wherein said rim mostly has a circular slightly upstanding form with an outer radius R, that is common for table ware such as saucers and dinner plates, wherein said rim element is executed as a U-shaped grip element or slide element with an upper radial lip length L1 and thickness T and a lower radial lip length L2 and a thickness T, wherein said upper lip and said lower lip are forming a mouth opening with a mouth width D for sideways sliding over mentioned rim of the central dinner plate with thickness d, wherein said U-shaped rim element has a circular width B, wherein the inside of the U-shaped rim element of the outer dinner has a concave shape Cc, that fits exactly into the convex shape Cv of the rim of the supporting central dinner plate with the stated radius R (R=Cv), wherein both the upper radial lip and the lower radial lip of the U-shaped rim element have an upstanding curvature C1 respectively C2 that corresponds with the curvature C3 of the rim of the supporting central dinner plate, wherein the material of said dinner plates is strong and shock resistant.

The advantages are, that both these convex and concave shapes, as well as the curvatures of the U-shaped rim element, provide a very stable connection between the central dinner plate and the outer dinner plates, in a horizontal, vertical and rotating sense. This significantly reduces the chance that the outer dinner plates will accidentally disconnect from the central dinner plate, which is an important advantage, especially when carrying the dinner plates. However, said stable connection, that is provided by the special geometry of the U-shaped rim element, does not make the intended disconnecting of the outer dinner plates from the central plate difficult during serving. By interconnecting these dinner plates, a very stable set of 2 to 10 interconnected dinner plates is formed, that is much more stable to hold and carry than several conventional dinner plates that are not interconnected and therefore loose and wobbly. The set of interconnected dinner plates can be held and carried at the central dinner plate with just one hand. The set of interconnected dinner plates makes the carrying and serving of several dinner plates simultaneously much safer, easier and more efficient. Other benefits are, that the set of interconnected dinner plates makes it possible for the waiter or waitress to serve more dinner guests simultaneously, which saves labour costs, shortens the waiting time for dinner guests, reduces the cooling down of food, reduces the number of accidents and reduces the number of logistical errors. Also, the set of dinner plates enables the waiter or waitress to have his or her other hand free for opening doors, switching on the light, serving the dinner plates, etc.

Furthermore, the dinner plate is characterized in that said length L1 is approximately 80% of length L2, and the width D of the U-shaped rim element is approximately 110% of the thickness of the circular upstanding rim of the central dinner plate.

The advantages are an easy putting in or sliding off from the outer dinner plates temporarily fixed to the central dinner plate.

The dinner plate is further characterized in that, the radius R has a size that is comparable to that of a conventional dinner plate with a circular slightly upstanding rim. The dimensions and design of the dinner plate do not differ from those of a conventional dinner plate, with exception of the integrated rim element.

The advantage is a good detachable connection between the dinner plates.

The dinner plate is further characterized in that, the circular width B of the U-shaped rim element is between 5 and 15% of the circumference of the dinner plate ($2\times\pi\times R$), preferably 10%.

The advantage is, that the U-shaped rim element is not too dominant compared to the size of the dinner plate and provides a good stability against rotation of the dinner plates when filled with food.

BRIEF DESCRIPTION OF THE DRAWING

The embodiment of the interconnectable dinner plate according to the present invention will now be described by way of example with reference to the accompanying drawing with figures, in which.

DETAILED DESCRIPTION

The reference numbers that are used in the text and in the figures of this document refer to specific parts of the dinner plates. These reference numbers remain the same throughout this document.

Figure 1:
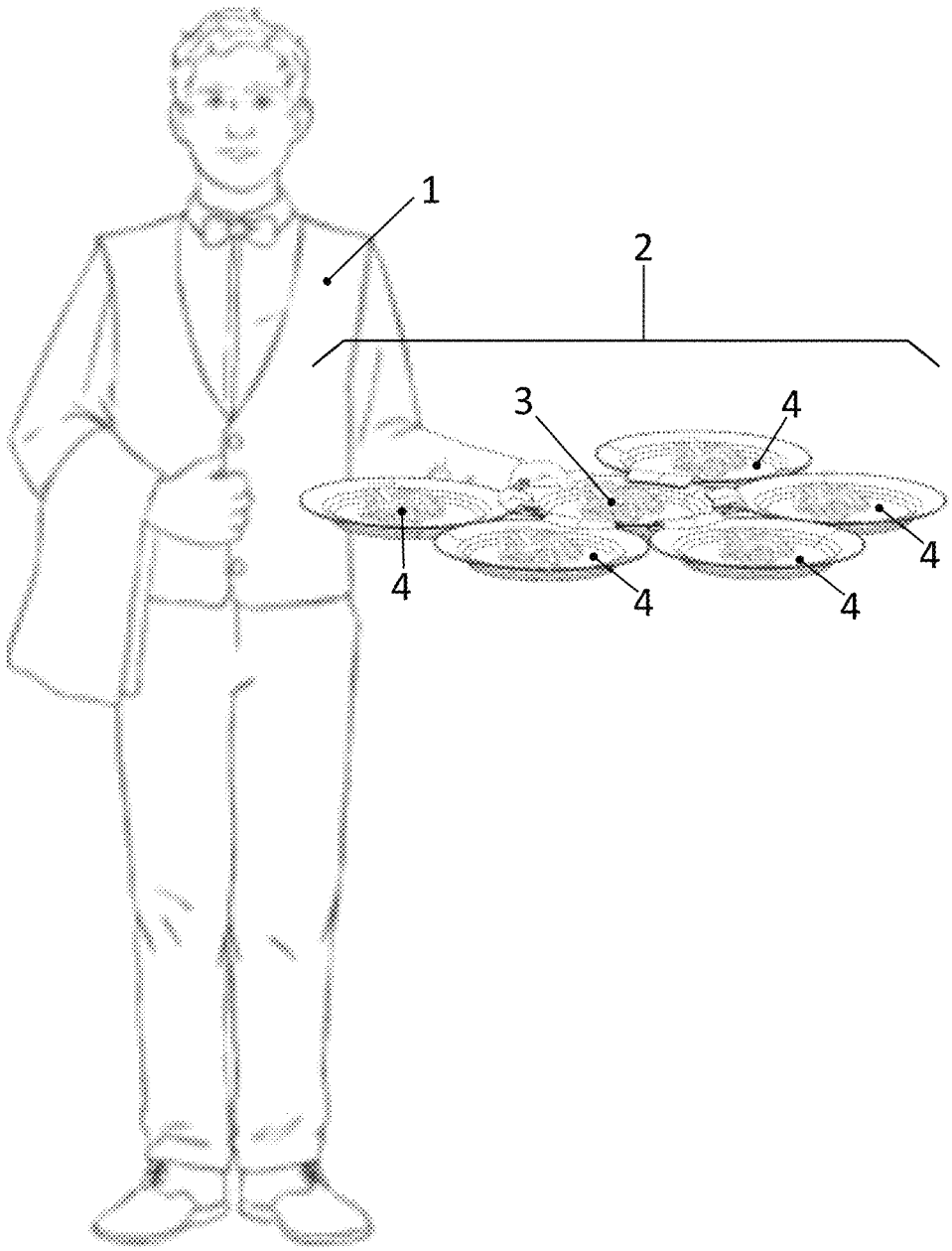
FIG. 1 shows a front view of a waiter supporting a set of temporarily interconnected dinner plates according to the invention.

FIG. 1 shows a front view of a waiter 1 carrying a set of interconnectable and identical dinner plates 2, being several outer dinner plates 4, that are grouped and connected around one centrally placed dinner plate 3 to form the set of interconnected dinner plates 2.

Figure 2:
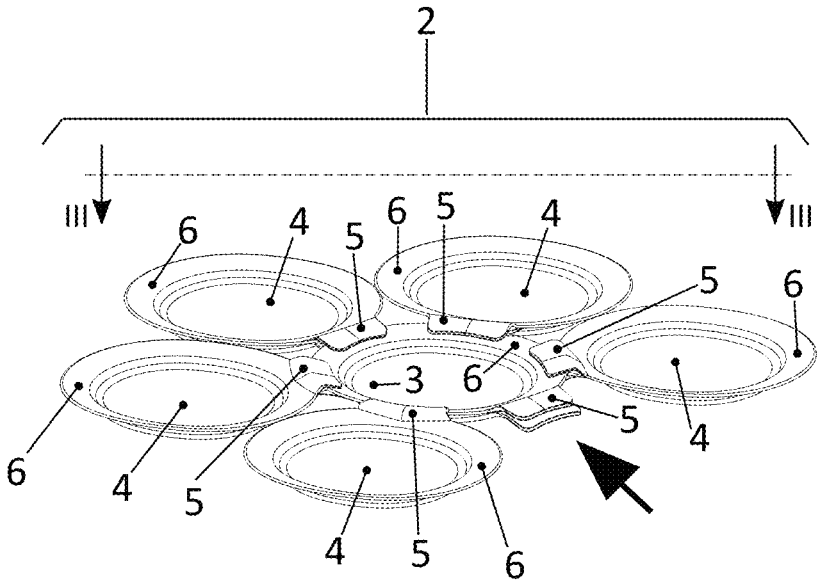
FIG. 2 shows an oblique projection of a set of interconnected dinner plates.

FIG. 2 shows an oblique projection of the set of the dinner plates 2. More and at a bigger scale herewith the integrated U-shaped rim elements 5 extended from the rims 6 of all dinner plates 3,4 are shown. The central dinner plate 3 is held by the waiter or waitress 1 at the black arrow. The outer dinner plates 4 are connected by sliding their U-shaped rim elements 5 over the rim 6 of the central dinner plate 3.

Figure 3:
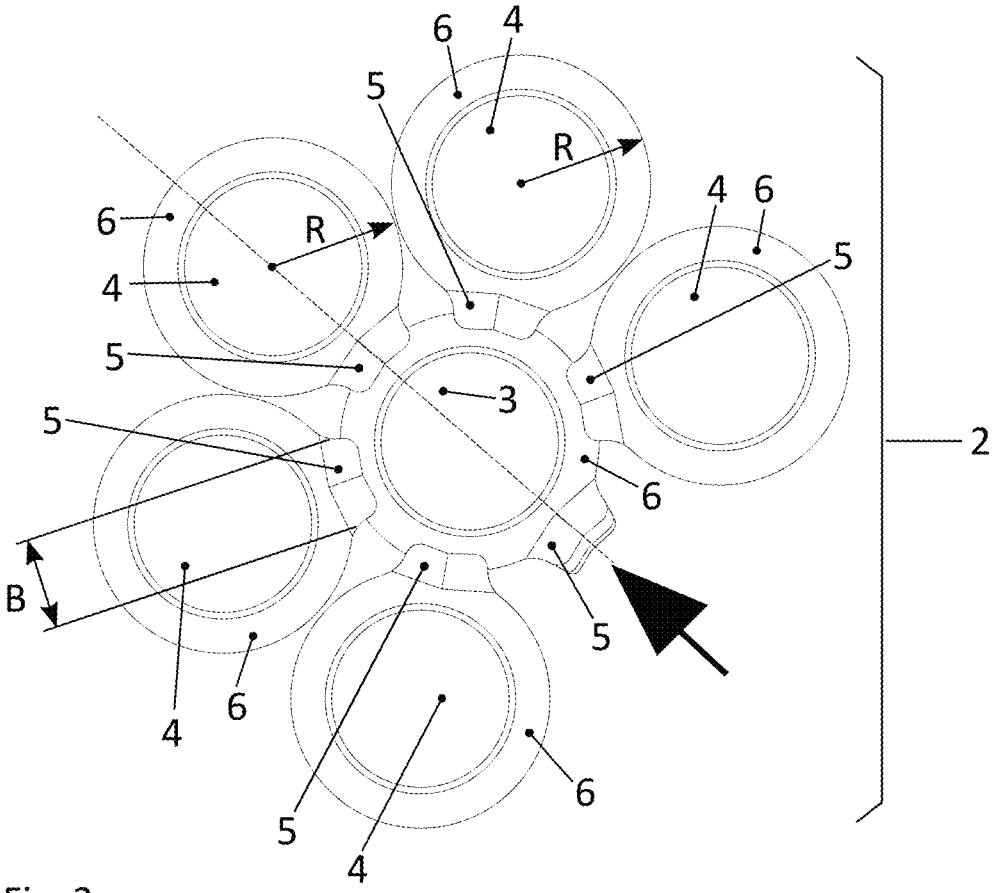
FIG. 3 shows a top view over the line III-III of FIG. 2.

FIG. 3 shows a top view over the line III-III of FIG. 2.

Figure 4:
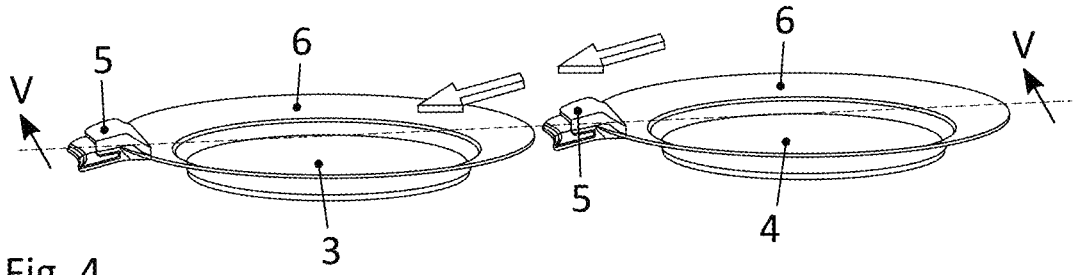
FIG. 4 shows an oblique projection of the procedure for interconnecting two dinner plates by using the U-shaped rim element being part of the rim of said dinner plate.

FIG. 4 represents an oblique projection of the procedure for interconnecting one outer dinner plate 4 to the central dinner plate 3. The integrated U-shaped rim element 5 of the outer dinner plate 4 slides over the rim 6 of the central dinner plate.

Figure 5A:
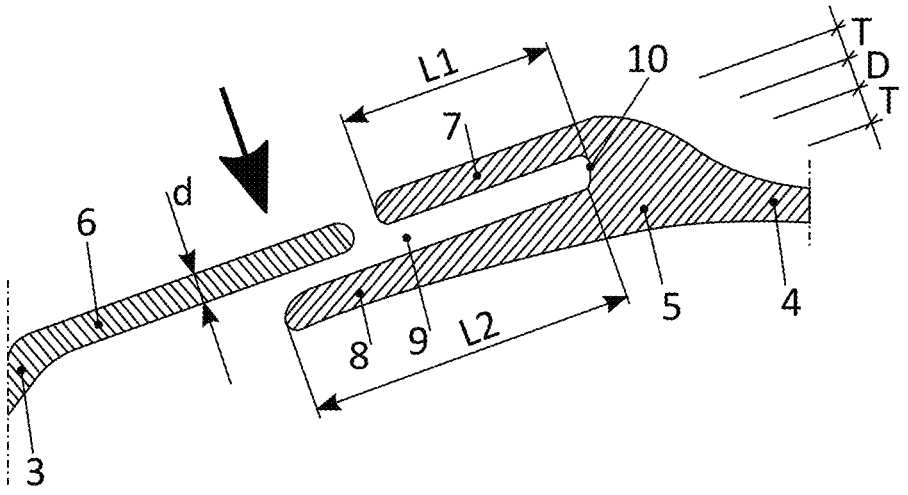
FIG. 5A-5C show the procedure for interconnecting two dinner plates.
Figure 5B:
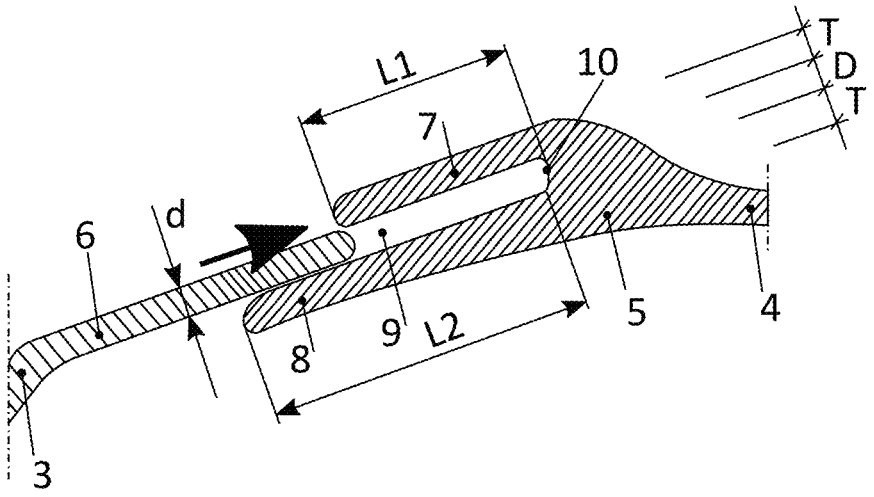
Figure 5C:
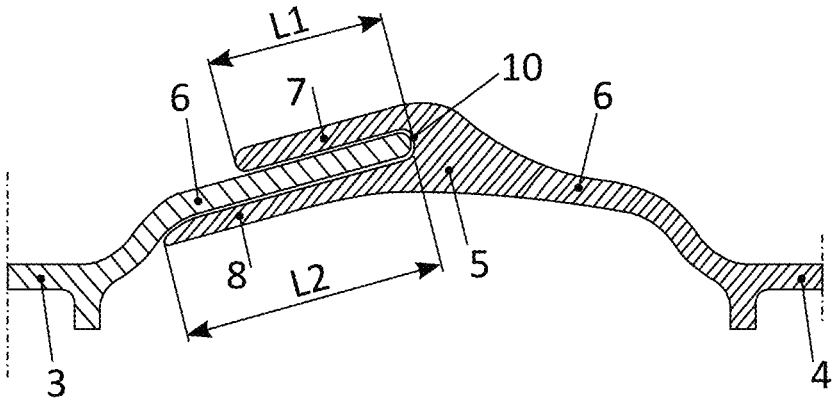

FIGS. 5A, 5B and 5C represent the procedure for interconnecting the dinner plates step-by-step in magnified cross sections. The U-shaped rim element 5 has an upper lip 7 with length L1 and thickness T and a lower lip 8 with length L2, wherein L2>L1. This is done for easy positioning of the U-shaped rim element 5 of the outer dinner plate 4 relative to the rim 6 of the central dinner plate 3 and therefore easily sliding the rim of the central dinner plate 6 into the mouth opening 9 of the U-shaped rim element 5. The mouth opening 9 of the U-shaped rim element 5 of the outer dinner plate 4 has an internal width D and the rim 6 of the central dinner plate 3 has a thickness d, wherein D>d and width D is approximately 110% of thickness d.

Each dinner plate 3, 4 has a circular central portion (not separately designated, see 3 and 4 in FIGS. 3 and 4) extending in a plane. The annular periphery 6 is conical and unitary with the circular central portion (at 3, 4) and disposed at least in part away from the plane of the circular central portion. As described above, the conical annular periphery has a uniform thickness d. The U- or J-shaped rim element 5 is a slotted attachment element integral with conical annular periphery or rim 6 at an outer edge (not separately designated) thereof. Slotted attachment or U- or J-shaped rim element 5 has a U- or J-shaped cross-section in a vertical radial plane of the circular central portion. As described above, slotted attachment or U- or J-shaped rim element 5 includes upper lip or flange 7 and lower lip or flange 8 that are parallel to and spaced one from the other to define mouth opening or slot 9 having width D. The upper lip or flange 7 and the lower lip or flange 8 each take the form of a conical section extending in both a circumferential direction about the conical annular periphery or rim 6 and outwardly therefrom. The width D of the mouth opening or slot 9 is larger than the uniform thickness d of the conical annular periphery 5. The mouth opening or slot 9 has an arcuate shape congruent with a section of the conical annular periphery 6.

Figure 6:
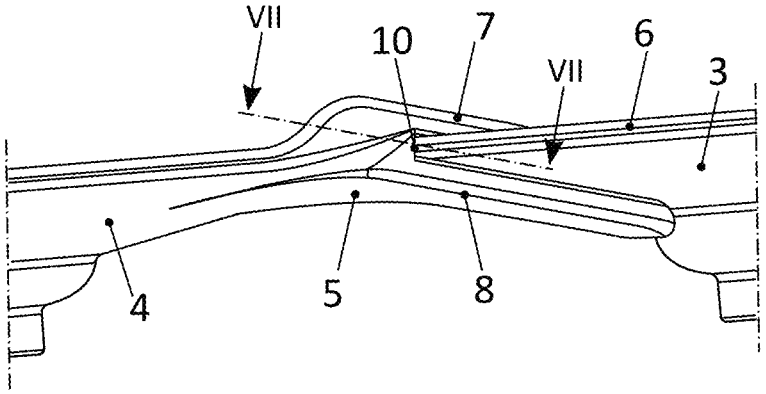
FIG. 6 shows an oblique view of the U-shaped rim element of one of the outer dinner plates hooked onto the rim of the central dinner plate.

FIG. 6 shows an oblique side view of the U-shaped rim element 5 of one of the outer dinner plates 4 hooked onto the rim 6 of the central dinner plate 3 with a reference to the line VII-VII.

Figure 7:
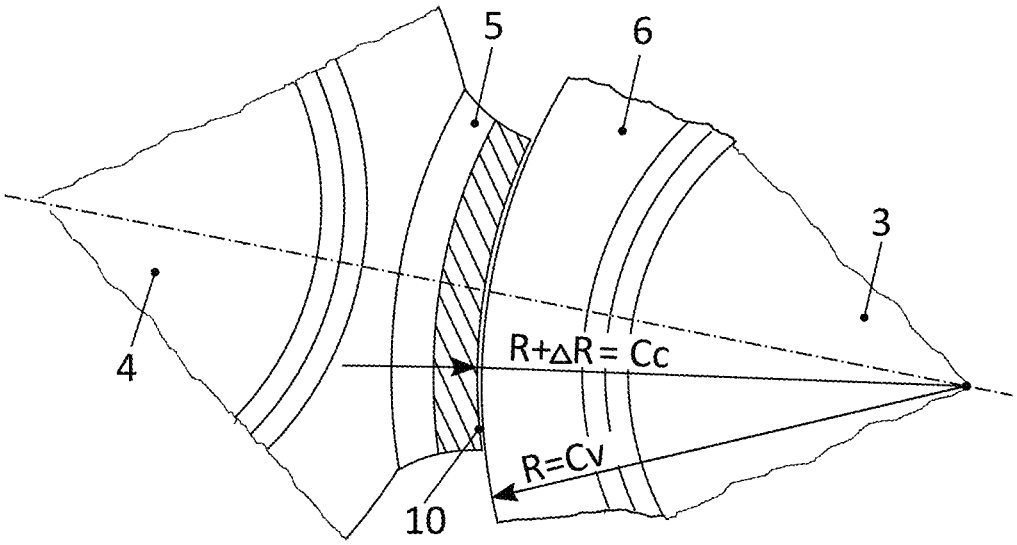
FIG. 7 shows a cross section over the line VII-VII of FIG. 6.

FIG. 7 shows a cross section over the line VII-VII of FIG. 6. The inside 10 of the U-shaped rim element 5 of the outer dinner plate 4 has a concave shape Cc that fits exactly into the convex shape Cv of the rim 6 of the supporting central dinner plate 3 with the stated radius R (R=Cv).

Figure 8:
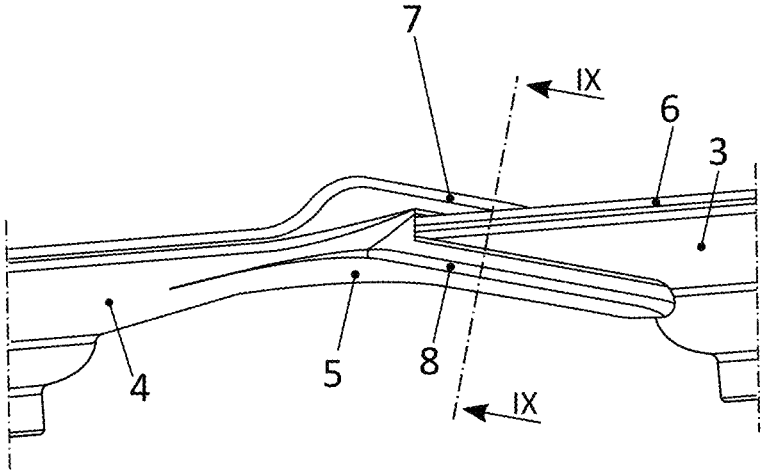
FIG. 8 shows another side view of the U-shaped rim element of one of the dinner plates hooked onto the rim of the central dinner plate.

FIG. 8 shows another oblique side view of the U-shaped rim element 5 of one of the outer dinner plates 4 hooked onto the rim 6 of the central dinner plate 3 with a reference to the line IX-IX.

Figure 9:
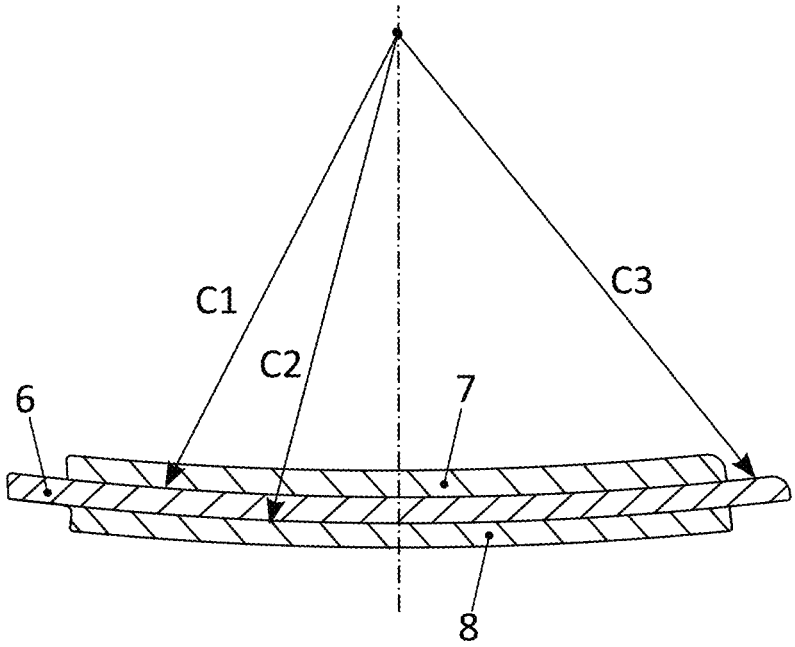
FIG. 9 shows a cross section over the line IX-IX of FIG. 8.

FIG. 9 shows a cross section over the line IX-IX of FIG. 8. The upper radial lip 7 has a curvature C1 and the lower radial lip 8 has a curvature C2 that both correspond with the curvature C3 of the rim 6 of the supporting central dinner plate 3.

However, it is obvious that modifications to the before described dinner plates with the inventive rim element can be made, but these shall remain within the field and scope of this invention.

The invention claimed is:

1. A dinner plate comprising:

a circular central portion extending in a plane;

a conical annular periphery unitary with said circular central portion and disposed at least in part away from said plane, said conical annular periphery having a uniform thickness; and a slotted attachment element integral with said conical annular periphery at an edge thereof, wherein:

said slotted attachment element has a U- or J-shaped cross-section in a vertical radial plane of said circular central portion;

said slotted attachment element includes an upper lip or flange and a lower lip or flange parallel to and spaced from the upper lip or flange to define a mouth opening or slot having a width;

said upper lip or flange and said lower lip or flange are each a conical section extending in both a circumferential direction about said conical annular periphery and outwardly from said conical annular periphery;

said width is larger than said uniform thickness; and said mouth opening or slot has an arcuate shape congruent with a section of said conical annular periphery.

2. The dinner plate defined in claim 1, wherein said upper lip or flange is smaller than said lower lip or flange, said upper lip or flange having a radial dimension or width that is approximately 80% of a radial dimension or width of said lower lip or flange.

3. The dinner plate defined in claim 1, wherein said slotted attachment element has a circumferential extension between 5% and 15% of the circumference of said annular periphery.

4. The dinner plate defined in claim 1, wherein the dinner plate is taken from the group consisting of saucers, pastry dishes, and serving trays.

5. The dinner plate defined in claim 1 wherein said mouth opening or slot of said slotted attachment element has an innermost side with a concave inner profile that is congruent with a contour of said edge of said annular periphery.

6. The dinner plate defined in claim 1 wherein said upper lip or flange and said lower lip or flange each have a curvature that parallels a curvature of said edge.

7. A dinner serving kit including at least two identical dinner plates each comprising:

a circular central portion extending in a plane;

a conical annular periphery unitary with said circular central portion and disposed at least in part away from said plane, said conical annular periphery having a uniform thickness; and a slotted attachment element integral with said conical annular periphery at an edge thereof, wherein:

said slotted attachment element has a U- or J-shaped cross-section in a vertical radial plane of said circular central portion;

said slotted attachment element includes an upper lip or flange and a lower lip or flange spaced from the upper lip or flange to define a mouth opening or slot having a width;

said upper lip or flange and said lower lip or flange are each a conical section extending in both a circumferential direction about said conical annular periphery and outwardly from said annular periphery;

said width is larger than said uniform thickness;

said mouth opening or slot has an arcuate shape congruent with a section of said conical annular periphery so that the annular periphery of one of said plates is insertable into the mouth opening or slot of another one of said plates.

8. The dinner serving kit defined in claim 7, wherein said upper lip or flange is smaller than said lower lip or flange, said upper lip or flange having a radial dimension or width that is approximately 80% of a radial dimension or width of said lower lip or flange.

9. The dinner serving kit defined in claim 7, wherein said slotted attachment element has a circumferential extension between 5% and 15% of a circumference of said annular periphery.

10. The dinner serving kit defined in claim 7, wherein each of the dinner plates is taken from the group consisting of saucers, pastry dishes, and serving trays.

11. The dinner serving kit defined in claim 7 wherein said mouth opening or slot of said slotted attachment element has an innermost side with a concave inner profile that is congruent with a contour of said edge of said annular periphery.

12. The dinner serving kit defined in claim 7 wherein said upper lip or flange and said lower lip or flange each have a curvature that parallels a curvature of said edge.

* * * * *